United States Patent [19]

Conrad

[11] 4,325,490

[45] Apr. 20, 1982

[54] NON-DETACHABLE RING PULL OPENING DEVICE FOR BEVERAGE CANS

[75] Inventor: Roger N. Conrad, Matteson, Ill.

[73] Assignee: The Continental Group, Inc., Stamford, Conn.

[21] Appl. No.: 197,721

[22] Filed: Oct. 16, 1980

[51] Int. Cl.[3] ..... B65D 17/34

[52] U.S. Cl. ..... 220/269; 220/270

[58] Field of Search ..... 220/268–273, 220/258, 359; 229/7 R; 113/1 F, 121 C

[56] References Cited

U.S. PATENT DOCUMENTS

| | | | |
|---|---|---|---|
| 3,291,336 | 12/1966 | Fraze | 220/273 |
| 3,365,095 | 1/1968 | Lipske | 220/273 |
| 4,031,836 | 6/1977 | Grise et al. | 113/1 F |
| 4,189,060 | 2/1980 | Trotman | 220/269 X |
| 4,192,244 | 3/1980 | Kelley et al. | 113/121 C |

*Primary Examiner*—George T. Hall

*Attorney, Agent, or Firm*—Charles E. Brown

[57] ABSTRACT

An easy opening container panel wherein a removable panel portion is primarily defined by a line of weakness or a score line. The line of weakness has a predetermined starting portion which is defined by a fracture in the residual of the container panel. The fracturing of the residual as opposed to a shearing thereof has the advantages of the elimination of the rapidly dulling lance required to effect the usual puncturing and at the same time the jagged edges resulting from the fracturing provide a mechanical interlock so that there is only a minimal weakening of the container panel over and above that provided by the score line.

3 Claims, 7 Drawing Figures

NON-DETACHABLE RING PULL OPENING DEVICE FOR BEVERAGE CANS

This invention relates in general to new and useful improvements in easy opening containers, and more particularly to an easy opening container wherein a removable panel portion is defined by a line of weakness and wherein the line of weakness has a ruptured starting portion to facilitate the initial opening operation. Further, an opening tab overlies the container panel and forms a seal therewith surrounding the line of weakness while at the same time having a permanent seal with the removable panel portion so as to effect the removal thereof.

It is well known to provide easy opening containers wherein a pull tab is releasably bonded to the container panel surrounding the opening area and wherein the pull tab is generally formed of a metal foil and may be in the form of a metal foil plastic film laminate with the plastic film being heat bondable to the container panel. The opening feature in the container panel has varied greatly, including permanent openings formed in the container panel, openings formed in the container panel with the removable portions reinserted and held in place by the pull tab, and removable panels defined by lines of weakness with the lines of weakness extending entirely through the container panel to initiate the removal of the removable panel portion.

This invention particularly relates to the type of easy opening container panel wherein a removable panel portion is defined by a line of weakness primarily in the form of a score and wherein the container panel is ruptured entirely therethrough at a starting point along the line of weakness. In the past, this through rupture of the container panel has been effected by a lance which cuts entirely through the container panel. Because of the high stresses placed upon the lance and the dulling action, it has been difficult to maintain the cutting edge life of the lance sufficiently to eliminate costly down time.

In accordance with this invention, the removable panel portion is first defined by a line of weakness primarily in the form of a score, after which a pair of cooperating oppositely working dies act upon the container panel to effect a fracture of a starting portion only of the residual of the container panel. By utilizing oppositely working dies, the necessity for a short lived sharp shearing tool is eliminated. Further, there is no true opening in the container panel. Instead, there is a mechanical interlock between the parts resulting from interengagement of jagged edges which result from the fracturing operation.

A typical removable panel portion is generally teardrop in outline and includes a large end and a small end, with the large end disposed radially outermost and the fracture being effected at the large end.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
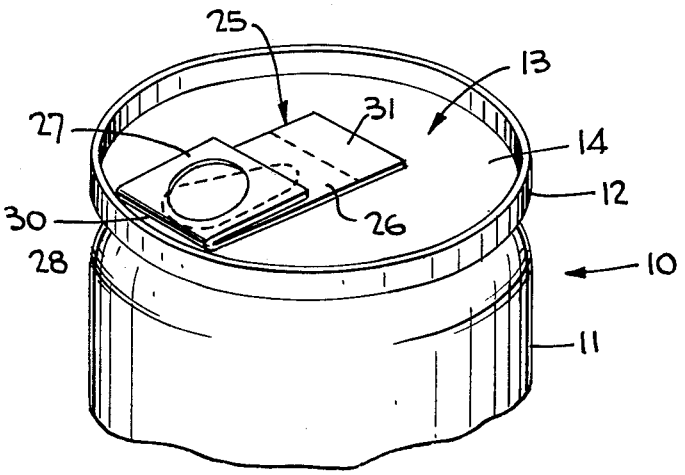
FIG. 1 is a fragmentary perspective view of a can formed in accordance with this invention with the pull tab in position for facilitating the opening of the end panel.

Referring now to the drawings in detail, it will be seen that there is illustrated in FIG. 1 an easy opening container formed in accordance with this invention, the container being generally identified by the numeral 10. The container 10 includes a conventional container body 11 to which there is secured by way of a conventional double seam 12 an end unit formed in accordance with this invention, the end unit being generally identified by the numeral 13.

Figure 2:
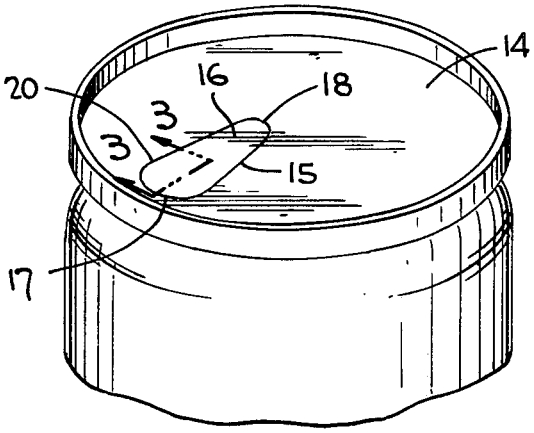
FIG. 2 is a fragmentary perspective view similar to FIG. 1, with the pull tab being omitted to show the details of the removable panel portion.

The end unit 13, except for the specific details of the invention to be described hereinafter, is of a conventional type and includes a recessed end panel 14. With reference to FIG. 2, the end panel 14 has formed therein a line of weakness 15 in the form of a score line. The score line 15 defines a generally teardrop shaped removable panel portion 16 having a radially outer large end 17 and a radially inner small end 18.

Figure 3:
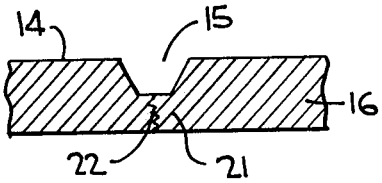
FIG. 3 is an enlarged fragmentary sectional view taken generally along the line 3—3 of FIG. 2, and shows the specific details of the fracture at the starting portion of the score.

The score line 15 has along the large end 17 a starting portion 20 which is the principal feature of this invention. Instead of the starting portion 20 being defined by a through cut as is shown in FIG. 3, a residual 21 resulting from the formation of the score line 15 is fractured as at 22. The fracture is such as to define jagged edges on the opposite sides of the line of fracture with these jagged edges being disposed in mechanically interlocked relation and thus serving generally to support the removable panel portion 16 notwithstanding the fracture.

Figure 4:
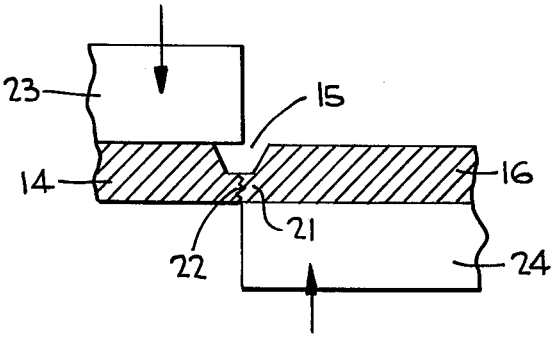
FIG. 4 is an enlarged fragmentary schematic vertical sectional view showing the manner in which the fracture of FIG. 3 is effected.

Referring now to FIG. 4, it will be seen that after the score line 15 has been formed, the end panel 13 is engaged by cooperating oppositely working dies 23, 24 which serve to apply a shearing force on the residual 21 along the starting portion 20 so as to effect the fracture 22. It is to be understood that the dies 23, 24 will be displaced relative to one another only sufficiently to effect the fracture and there will be no offsetting of portions of the end panel.

Although the dies 23, 24 have only been schematically illustrated, it is to be understood that the dies 23, 24 may be of any operable configuration and the relationship of the dies 23, 24 may be readily reversed.

The container 10 also includes a pull tab or tape generally identified by the numeral 25. The tab or tape 25 is in the form of an elongated strip of readily bendable material, and normally will be in the form of a metal foil, plastic film laminate. The plastic film will be compatible with a coating on the upper surface of the end panel 14 so as to be heat bondable thereto.

The pull tab or tape 25 includes a body portion 26 which overlies the end panel 14 and a grip portion 27 which generally overlies one end of the body portion 26 and is preferably provided with a finger receiving aperture 28. The grip portion 27 is joined to the body portion 26 along a transverse fold line 30.

If necessary, suitable adhesive means or suitable coatings may be applied to the pull tab or tape 25 so that it has a peelable seal with the end panel 14 surrounding the removable panel portion 16, but will have a permanent bond with the removable panel portion 16. Further, that end part of the body portion disposed radially inwardly of the inner end of the removable panel portion 16 will be permanently bonded to the end panel 14 as at 31.

Figure 5:
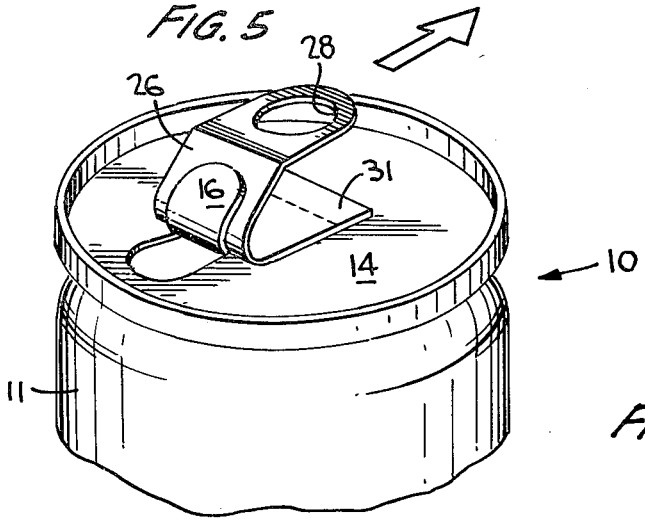
FIG. 5 is a fragmentary top perspective view similar to FIG. 1 with the pull tab in its partially opened position.
Figure 6:
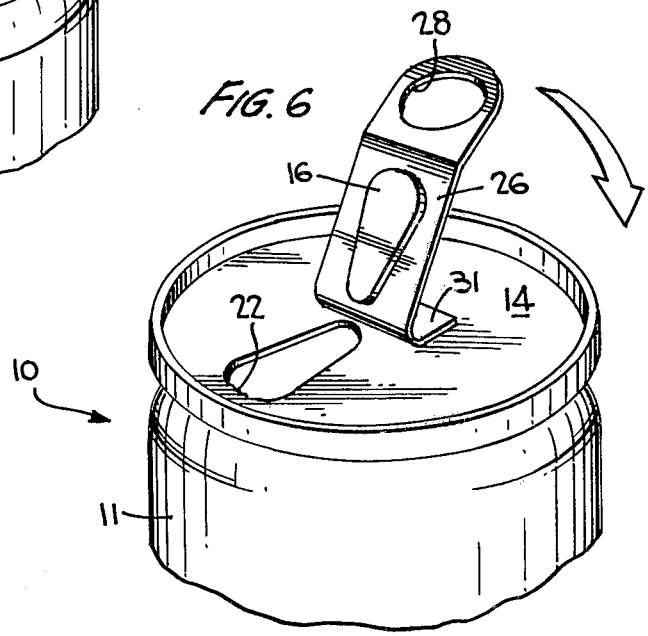
FIG. 6 is a perspective view similar to FIG. 5 and shows the pull tab in its fully opened position.
Figure 7:
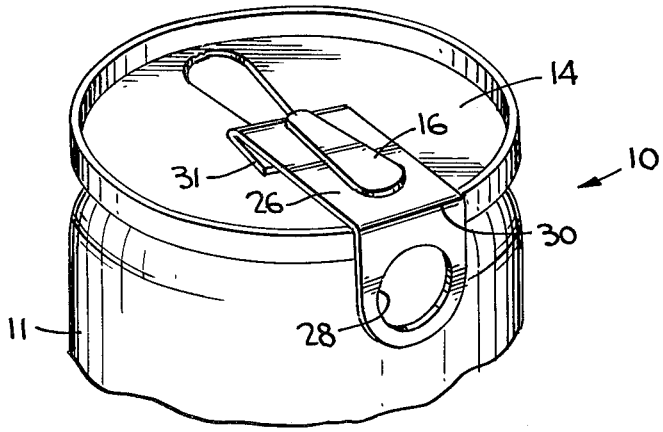
FIG. 7 is another perspective view, rotated 90°, and shows the manner in which the pull tab is locked over the container seam or rib.

With reference to FIGS. 5, 6 and 7, in operation the grip portion 27 will be engaged and lifted away from the end panel 14 so as to effect a peeling of the body portion 26 from the end panel 14. This will result in the progesssive tearing of the removable panel portion 16 from the end panel 14, as is shown in FIG. 5.

The opening operation will continue until the removable panel portion 16 has been totally torn from the end panel 14 and the permanent seal 31 has been reached, as is shown in FIG. 6.

With reference to FIG. 7, it will be seen that the linear extent of the body portion 26 between the permanent bond 31 and the fold line 30 will be equal to the distance from the beginning of the permanent bond 31 to the diametrically opposite portion of the seam 12. Thus, after the full opening has been effected, the pull tape may be folded into overlying relation to the end panel 14 with the fold line 30 being engaged over the seam or rim 12 surrounding the end panel and with the grip portion 27 in depending relation alongside the exterior of the can body 11 as shown in FIG. 7.

Inasmuch as the removable panel portion 16 will remain attached to the pull tab and the pull tab will remain attached to the end unit, it will be seen that the opening device is of the non-detachable type. Further, the raw edges of the removable panel portion 16 will be generally masked by the pull tab.

In view of the mechanical interlock of the jagged edges across the line of fracture 22, it will be seen that the line of weakness plus fracture arrangement will be such that the end panel will still have a very great structural strength and that the resultant assembly will not be subjected to unexpected or undesired blow-out.

Although only a preferred embodiment of the invention has been specifically illustrated and described herein, it will be understood that minor variations may be made in the easy opening container, particularly in the shape of the removable panel portion, without departing from the spirit and scope of the invention as defined by the appended claims.

I claim:

1. An easy opening container assembly comprising a container panel, a line of weakness in said container panel defining a removable panel portion, said line of weakness having a starting portion; the improvement residing in said container panel being fractured along said line of weakness starting portion, said fractured starting portion including jagged edges on said container panel and said removable panel portion disposed in mechanical interlocked relation, an opening tab, said opening tab including a body portion overlying said removable panel portion and being releasably sealed to said container panel surrounding said line of weakness and permanently secured to said removable panel portion radially outwardly of said removable panel portion, said tab including a grip portion extending from said body portion adjacent said line of weakness starting portion, and said body portion having a terminal part permanently bonded to said container panel remote from said grip portion.

2. A container assembly according to claim 1 wherein said removable panel portion is generally teardrop in outline and includes a large end and a small end, and said starting portion being at said small end.

3. A container assembly according to claim 1 wherein said container panel is an end panel of an end unit formed to a container body by an upstanding seam, said grip portion is joined to said body portion along a fold line; and the relative dimensions of said end panel and said tab body portion being one wherein when said container is opened, said fold line will overlie said seam and said opening tab will interlock with said seam.

* * * * *